US009481921B2

(12) United States Patent
Na et al.

(10) Patent No.: US 9,481,921 B2
(45) Date of Patent: Nov. 1, 2016

(54) ZIRCONIUM ALLOY COMPOSITION HAVING LOW HYDROGEN PICK-UP RATE AND HIGH HYDROGEN EMBRITTLEMENT RESISTANCE AND METHOD OF PREPARING THE SAME

(71) Applicant: KEPCO NUCLEAR FUEL CO., LTD., Daejeon (KR)

(72) Inventors: Yeon Soo Na, Daejeon (KR); Yong Kyoon Mok, Daejeon (KR); Yoon Ho Kim, Daejeon (KR); Chung Yong Lee, Daejeon (KR); Min Young Choi, Daejeon (KR); Tae Sik Jeong, Daejeon (KR); Jung Ho Shin, Daejeon (KR); Seung Jae Lee, Daejeon (KR); Jung Min Suh, Daejeon (KR)

(73) Assignee: KEPCO NUCLEAR FUEL CO., LTD., Daejeon (KR)

( * ) Notice: Subject to any disclaimer, the term of this patent is extended or adjusted under 35 U.S.C. 154(b) by 245 days.

(21) Appl. No.: 14/301,405

(22) Filed: Jun. 11, 2014

(65) Prior Publication Data

US 2015/0292071 A1 Oct. 15, 2015

(30) Foreign Application Priority Data

Apr. 10, 2014 (KR) ..... 10-2014-0042991

(51) Int. Cl.
*C22F 1/18* (2006.01)
*C22C 16/00* (2006.01)

(52) U.S. Cl.
CPC ..... *C22F 1/186* (2013.01); *C22C 16/00* (2013.01)

(58) Field of Classification Search
CPC ..... C22C 16/00
See application file for complete search history.

(56) References Cited

U.S. PATENT DOCUMENTS

| | | | |
|---|---|---|---|
| 4,938,920 | A | 7/1990 | Garzarolli et al. |
| 5,254,308 | A | 10/1993 | Garde et al. |
| 5,648,995 | A | 7/1997 | Mardon et al. |
| 5,940,464 | A | 8/1999 | Mardon et al. |
| 2003/0098105 | A1 | 5/2003 | Jeong et al. |
| 2009/0071579 | A1 | 3/2009 | Hallstadius et al. |
| 2010/0014624 | A1 | 1/2010 | Lutz et al. |
| 2010/0128834 | A1 | 5/2010 | Colburn et al. |

FOREIGN PATENT DOCUMENTS

KR 10-2009-0092489 A1 9/2009

OTHER PUBLICATIONS

Antoinia V. Nikulina et al., "Zirconium Allow E635 as a Material for Fuel Rod Cladding and Other Components of VVER and RBMK Cores", 11$^{th}$ International Symposium on Zirconium in the Nuclear Industry, ASTM STP 1295, 1996, pp. 785-803.

*Primary Examiner* — Jessee Roe
*Assistant Examiner* — Christopher Kessler
(74) *Attorney, Agent, or Firm* — Rabin & Berdo, P.C.

(57) ABSTRACT

Disclosed herein are zirconium alloy compositions having a low hydrogen pick-up rate and high hydrogen embrittlement resistance. This zirconium alloy composition can be usefully used as a nuclear fuel components in a nuclear power plant because it has a very low hydrogen pick-up rate and high hydrogen embrittlement resistance under operation environments of nuclear power plant.

4 Claims, 4 Drawing Sheets

HYDROGEN CONTENTS ACCORDING TO HYDROGEN-CHARGING TIME OF ZIRCONIUM ALLOYS BY HYDROGEN-CHARGING APPARATUS

SCHEMATIC DIAGRAM FOR PREPARING ZIRCONIUM ALLOY COMPOSITION

EXAMPLE 11 ZIRCALOY-4

OPTICAL MICROSTRUCTURE OF ZIRCONIUM ALLOY AFTER CHARGING HYDROGEN FOR 5 HOURS

TRANSMISSION ELECTRON MICROSCOPE PHOTOGRAPH OF MICROSTRUCTURE OF ZIRCONIUM ALLOYS

HYDROGEN CONTENTS ACCORDING TO HYDROGEN-CHARGING TIME OF ZIRCONIUM ALLOYS BY HYDROGEN-CHARGING APPARATUS

ZIRCONIUM ALLOY COMPOSITION HAVING LOW HYDROGEN PICK-UP RATE AND HIGH HYDROGEN EMBRITTLEMENT RESISTANCE AND METHOD OF PREPARING THE SAME

BACKGROUND OF THE INVENTION

1. Technical Field

The present invention relates to a zirconium alloy and a method of preparing the same. More particularly, the present invention relates to a method of preparing a zirconium alloy having a low hydrogen pick-up rate and high hydrogen embrittlement resistance, and to a zirconium alloy composition having a low hydrogen pick-up rate and high hydrogen embrittlement resistance.

2. Description of the Related Art

Zirconium alloys are used for nuclear fuel cladding tubes, guide tubes and spacer grids as nuclear fuel component in a nuclear power plant. Under the operation environments of a nuclear power plant, the mechanical properties of zirconium alloys deteriorate because of high-temperature and high-pressure corrosion environment and neutron irradiation. Zirconium, as a raw material of zirconium alloys, has a very small neutron absorption cross section, excellent high-temperature strength and corrosion resistance, and is widely used in a nuclear reactor core in the form of an alloy containing a small amount of niobium, iron, chromium or the like.

Among conventional zirconium alloys, zircaloy-2 and zircaloy-4 containing tin, iron, chromium and nickel are most widely used. Currently, ZIRLO, which a zirconium alloy prepared by adding a small amount of niobium, iron, chromium, etc. to zirconium, is used world-wide.

However, recently, as part of the improvement in economic efficiency of nuclear reactor, a high burn-up for extending nuclear fuel cycles has been used within a severe environment, and thus the reaction time of nuclear fuel with high-temperature and high-pressure cooling water increases, thereby causing problems of nuclear fuel corrosion and hydrogen embrittlement. Owing to a hydrogen pick-up by zirconium alloy corrosion, the hydrides in zirconium matrix are formed and the strength of the zirconium alloy becomes very low due to delayed hydride cracking (DHC) and fracture toughness deterioration by hydride.

Therefore, it is necessary to develop a zirconium alloy having excellent corrosion resistance and hydrogen embrittlement resistance under primary cooling water environment with a high-temperature and high-pressure in a nuclear power plant. For this reason, research into developing a zirconium alloy having high corrosion resistance and a low hydrogen pick-up rate has been variously conducted. In this case, since the optimization conditions for providing a low hydrogen pick-up rate and high hydrogen embrittlement resistance to a zirconium alloy are influenced by the kind and amount of added elements, processing condition, heat treatment condition or the like, it is most important to establish an alloy design and an alloy preparation process.

The paper "Zirconium Alloy E635 as a Material for Fuel rod Cladding and Other Components of VVER and RBMK Cores, $11^{th}$ International Symposium on Zirconium in the Nuclear Industry, ASTM STP 1295, eds. by Bradley and Sabol, pp. 785~803, written by Nikulina et al." discloses the fact that a zirconium alloy, prepared by adding 0.95~1.05 wt % of niobium, 1.2~1.3 wt % of tin and 0.34~0.4 wt % of iron to zirconium, has very excellent corrosion resistance when the ingot of the zirconium alloy is β-annealed at 900~1070° C., water-cooled, α-pressed at 600~650° C., cold-worked and intermediate-heat-treated (heat treatment temperature: 560~620° C.) three to four times, and then final-treated at 560~620° C.

U.S. Pat. No. 4,938,920 discloses a zirconium alloy composition including niobium 0~1.0 wt %, tin 0~0.8 wt %, vanadium 0~0.3 wt %, iron 0.2~0.8 wt %, chromium 0~0.4 wt %, oxygen 0.1~0.16 wt % and a residue of zirconium. Here, when the total amount of chromium and vanadium is adjusted within a range of 0.25~1.0 wt %, this zirconium alloy has higher corrosion resistance than that of zircaloy-4.

U.S. Pat. No. 5,254,308 discloses a zirconium alloy composition having improved corrosion resistance and a hydrogen pick-up rate, including niobium 0.015~0.3 wt %, tin 1.0~2.0 wt %, iron 0.07~0.7 wt %, chromium 0.05~0.15 wt %, nickel 0.16~0.4 wt %, silicon 0.002~0.050 wt %, oxygen 0.09~0.16 wt % and a residue of zirconium. Here, the zirconium alloy composition is configured such that the ratio of iron and chromium is 1.5, the amount of added niobium is determined depending on the additive amount of iron influencing a hydrogen pick-up rate, and the additive amount of nickel, silicon, carbon or oxygen is determined to allow the zirconium alloy to have excellent corrosion resistance and strength.

U.S. Pat. No. 5,648,995 discloses a method of fabricating a nuclear fuel cladding tube using a zirconium alloy including niobium 0.8~1.3 wt %, iron 50~250 ppm, oxygen 1600 ppm or less, silicon 120 ppm or less. In this method, a nuclear fuel cladding tube was fabricated by the steps of: primarily heat-treating the zirconium alloy at 1000~1200° C., β-quenching the zirconium alloy, secondarily heat-treating the quenched zirconium alloy and then extruding this zirconium alloy; cold-rolling the extruded zirconium alloy 4~5 times; intermediate-heat-treating the cold-rolled zirconium alloy at a temperature range of 565~605° C. for 2~4 hours between the cold-rolling steps; and final-heat-treating this zirconium alloy at 580° C. In this case, in order to improve the creep resistance of the nuclear fuel cladding tube, the content of iron in the zirconium alloy is restricted within a range of 250 ppm or less, and the content of oxygen in the zirconium alloy is restricted within a range of 1000~1600 ppm.

U.S. Pat. No. 5,940,464 discloses a process of preparing a zirconium alloy including niobium 0.9~1.1 wt %, tin 0.25~0.35 wt %, iron 0.2~0.3 wt %, carbon 30~180 ppm, silicon 10~120 ppm, oxygen 600~1800 ppm and a residue of zirconium. The prepared zirconium alloy was heat-treated at 1000~1200° C., quenched, drawn at 600~800° C., and then heat-treated at 590~650° C. Subsequently, this zirconium alloy was cold-rolled four or more times, and then intermediate-heat-treated at 560~620° C. between the cold rolling steps. Thereafter, this zirconium alloy was finally cold-rolled, and then finally heat-treated by recrystallization annealing (RXA, 560~620° C.) and stress relief annealing (SRA, 470~500° C.).

As described above, research for improving the corrosion resistance, hydrogen embrittlement resistance and a low hydrogen pick-up rate of zirconium alloys used for nuclear reactor core materials such as nuclear fuel cladding tubes and the like has been variously conducted. It is continuously required to develop zirconium alloys having a low hydrogen pick-up rate and high hydrogen embrittlement resistance that can maintain the stability of nuclear fuel during a high burn-up efficiency long-period operation.

Therefore, as the present inventors have conducted research for developing new zirconium alloys as replacements for conventional zirconium alloys, they have found that new zirconium alloy compositions have lower hydrogen pick-up rate and higher hydrogen embrittlement resistance than those of conventional zirconium alloy compositions. Based on this finding, the present invention has been created.

SUMMARY OF THE INVENTION

Accordingly, the present invention has been devised to solve the above-mentioned problems, and an object of the present invention is to provide a zirconium alloy having a low hydrogen pick-up rate and high hydrogen embrittlement resistance, which can be used for nuclear reactor core materials such as nuclear fuel cladding tubes, structure material and the like, and a method of preparing the same.

In order to accomplish the above object, an aspect of the present invention provides a method of preparing a zirconium alloy having a low hydrogen pick-up rate and high hydrogen embrittlement resistance, including the steps of: 1) melting a mixture of components of a zirconium alloy to prepare an ingot; 2) β-annealing the ingot at 1000~1050° C. for 30~40 min and then rapidly cooling (β-quenching) the annealed ingot with water; 3) preheating the heat-treated ingot to 630~650° C. for 20~30 min and then hot-rolling the preheated ingot at a reduction ratio of 60~65%; 4) primarily intermediate-vacuum-heat-treating the hot-rolled product at 560~580° C. for 3~4 hours and then primarily cold-rolling the product at a reduction ratio of 50~60%; 5) secondarily intermediate-vacuum-heat-treating the primarily cold-rolled product at 570~590° C. for 2~3 hours and then secondarily cold-rolling the product at a reduction ratio of 50~60%; 6) thirdly intermediate-vacuum-heat-treating the secondarily cold-rolled product at 570~590° C. for 2~3 hours and then thirdly cold-rolling the product at a reduction ratio of 55~65%; and 7) finally heat-treating the thirdly cold rolled product in vacuum at 460~470° C. for 8~9 hours.

Zirconium alloy compositions having a low hydrogen pick-up rate and high hydrogen embrittlement resistance are as follows.

(1) A zirconium alloy composition, including: niobium 1.0~1.4 wt %; scandium 0.1~0.3 wt %; aluminum 0.04~0.06 wt %; tin 0.1~0.3 wt %; iron 0.04~0.06 wt %; and a residue of zirconium (2) A zirconium alloy composition, including: niobium 1.0~1.4 wt %; scandium 0.1~0.3 wt %; aluminum 0.04~0.06 wt %; copper 0.04~0.08 wt %; and a residue of zirconium.

(3) A zirconium alloy composition, including: niobium 1.2~1.4 wt %; scandium 0.1~0.3 wt %; aluminum 0.04~0.06 wt %; chromium 0.1~0.2 wt %; and a residue of zirconium.

(4) A zirconium alloy composition, including: niobium 1.2~1.4 wt %; scandium 0.1~0.3 wt %; chromium 0.1~0.3 wt %; and a residue of zirconium.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF THE PREFERRED EMBODIMENTS

Figure 1:
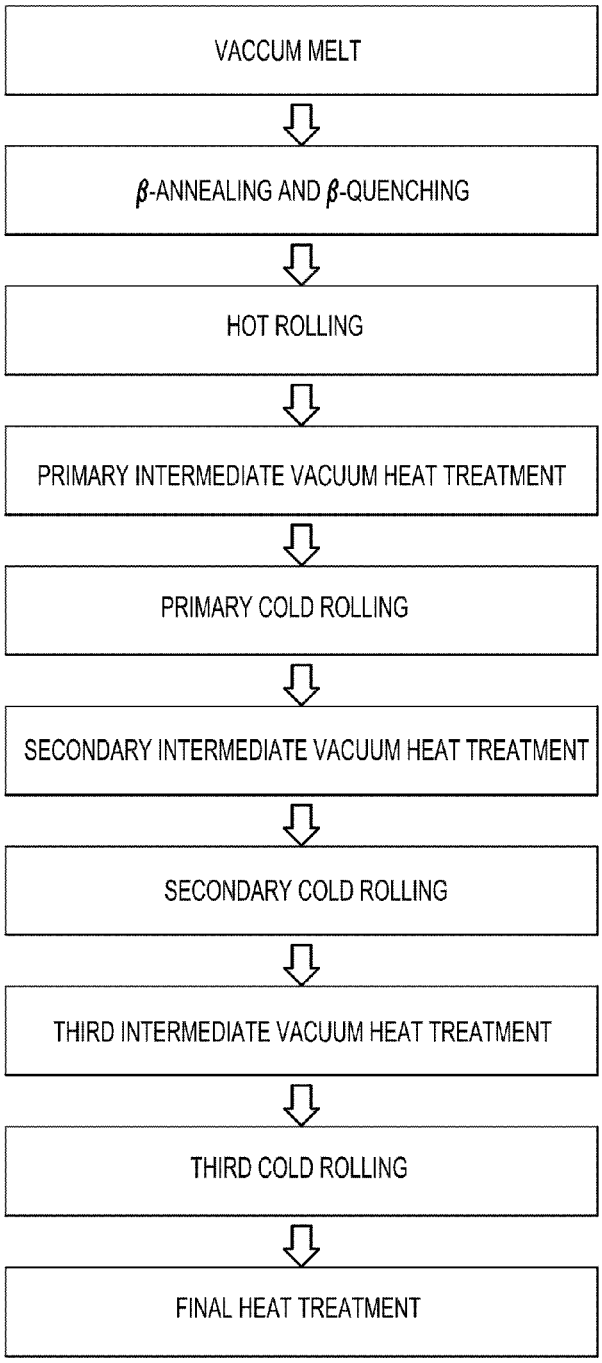
FIG. 1 is a schematic diagram showing a method of preparing a zirconium alloy according to the present invention.
Figure 2:
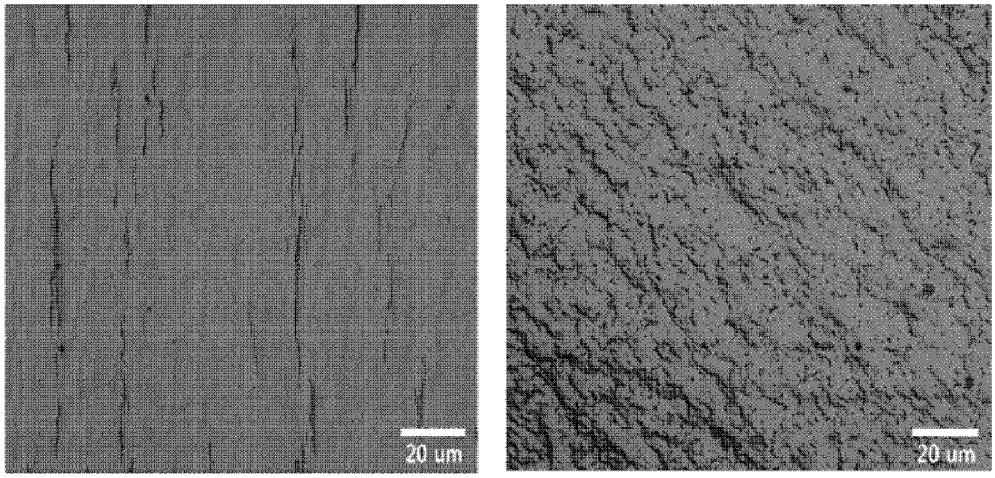
FIG. 2 shows optical microscope (OM) photographs of microstructures of zirconium alloys after hydrogen-charging according to the present invention.
Figure 3:
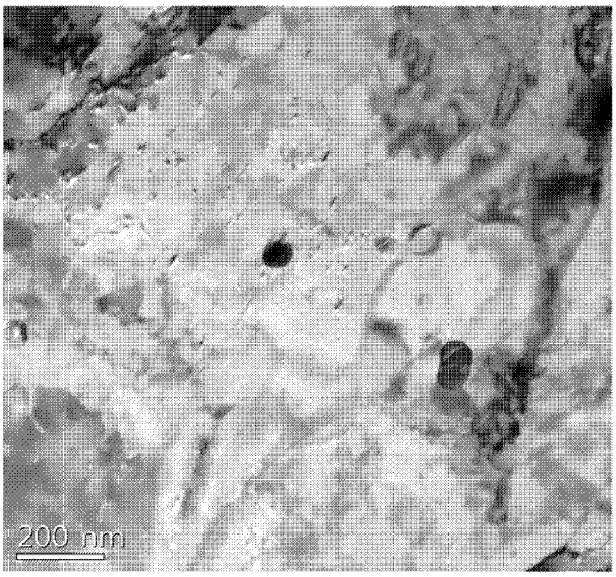
FIG. 3 shows a transmission electron microscope (TEM) photograph of a microstructure of a zirconium alloy according to the present invention.
Figure 3:
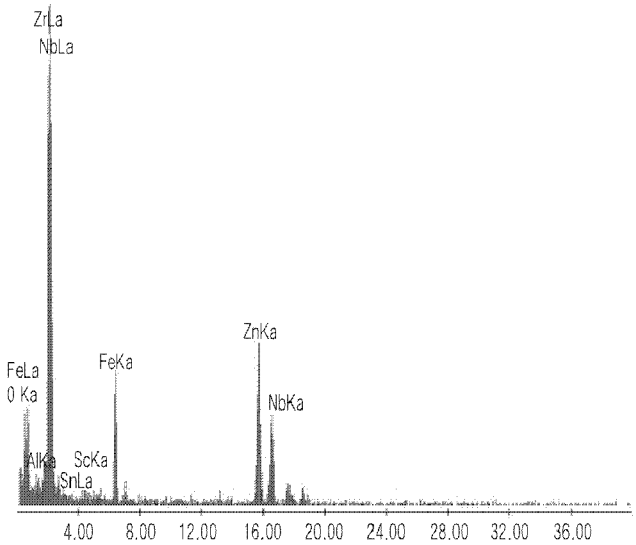
Figure 4:
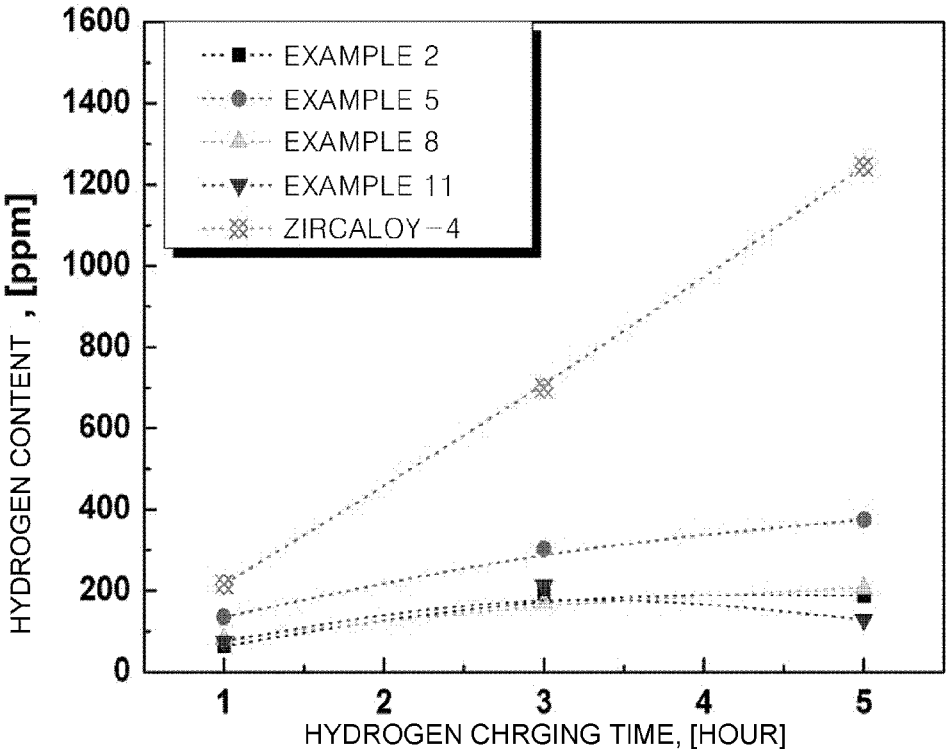
FIG. 4 is a graph showing the hydrogen pick-up rate of a zirconium alloy to hydrogen-charging time after a hydrogen-charging test according to the present invention.

Hereinafter, the present invention will be described in detail with reference to the following examples. However, these examples are set forth to illustrate the present invention, and the scope of the present invention is not limited thereto.

Example 1

Preparation of Zirconium Alloy (1) Preparation of Ingot

The zirconium alloy compositions given in Table 1 below were designed to produce a final hydrogen-charging specimen.

The composition of zirconium alloys given in Table 1 below was melted using vacuum arc remelting (VAR) to prepare an ingot. Here, as zirconium, nuclear grade zirconium sponge, specified in ASTM B349, was used, and niobium, scandium, aluminum, tin, iron, chromium, copper and the like, each having high purity of 99.99% or more, were used. Meanwhile, in order to prevent the segregation of impurities and the non-uniform distribution of a zirconium alloy composition, the melting of the mixture was repeatedly performed three or more times. Further, in order to prevent the mixture from being oxidized at the time of melting the mixture, the pressure in a chamber of a vacuum arc remelting apparatus was sufficiently maintained under a vacuum of $10^{-5}$ torr or less, and then the melting of the mixture was performed, thereby preparing an ingot.

(2) β-Solution Heat Treatment (β-Annealing) and β-Quenching

In order to destroy the cast structure in the ingot and prevent the segregation of the ingot by homogenizing the alloy composition in the ingot, the ingot was solution-heat-treated (β-annealed) in the β-region of zirconium at 1000~1050° C. for 30~40 min, and then rapidly cooled (β-quenched) with water. In order to retard the oxidization of the ingot during the solution heat treatment (β-annealing) and allow the ingot to be easily inserted between rollers during hot rolling, the ingot is coated with a stainless steel plate having a thickness of 1 mm, and then spot-welded. Further, the β-quenching of the ingot was performed in order to control the size of secondary phase particles (SPP) in the base metal of the ingot, and the ingot was cooled at a cooling rate of about 300° C./sec or more.

(3) Preheating and Hot Rolling

The β-quenched ingot was preheated to 630~650° C. for 20~30 min, and then hot-rolled at a reduction ratio of 60~65%. When the reduction ratio of the hot-rolled product is less than 60%, there is a problem in that the crystal texture of zirconium becomes non-uniform, thus deteriorating the hydrogen embrittlement resistance thereof, and, when the reduction ratio thereof is more than 65%, it is difficult to process the hot-rolled product in the subsequent step.

(4) Primary Intermediate Vacuum Heat Treatment and Primary Cold Rolling

The stainless steel plate was removed from the hot rolled product, and then the zirconium oxide film formed during the hot rolling was removed using an acid solution containing water, nitric acid and hydrofluoric acid at a volume ratio of 50:40:10, and then the hot-rolled product was primarily intermediate-vacuum-heat-treated at 560~580° C. for 3~4 hours. In this case, in order to prevent the oxidization of the hot-rolled product, the primary intermediate vacuum heat treatment of the hot-rolled product was performed while maintaining a vacuum at $10^{-5}$ torr or less. It is preferred that the primary intermediate vacuum heat treatment of the hot-rolled product be performed at recrystallization heat treatment temperature in order to prevent the damage of a specimen during cold rolling. When the primary intermediate vacuum heat treatment temperature deviates from the above temperature range, there is a problem of deteriorating corrosion resistance.

The primarily intermediate-vacuum-heat-treated hot-rolled product was primarily cold-rolled at a reduction ratio of 50~60%.

(5) Secondary Intermediate Vacuum Heat Treatment and Secondary Cold Rolling

The primarily cold-rolled product was secondarily intermediate-vacuum-heat-treated at 570~590° C. for 2~3 hours.

The secondarily intermediate-vacuum-heat-treated cold-rolled product was secondarily cold-rolled at a reduction ratio of 50~60%.

(6) Third Intermediate Vacuum Heat Treatment and Third Cold Rolling

The secondarily cold-rolled product was thirdly intermediate-vacuum-heat-treated at 570~590° C. for 2~3 hours.

The thirdly intermediate-vacuum-heat-treated cold-rolled product was thirdly cold-rolled at a reduction ratio of 55~65%.

(7) Final Vacuum Heat Treatment

The thirdly cold-rolled product was finally heat-treated under a high vacuum atmosphere. The final heat treatment was performed by stress relief annealing (SRA), partial recrystallization annealing (PRXA) or recrystallization annealing (RXA) according to the purpose thereof. The stress relief annealing (SRA) was performed at 460~470° C. for 8~9 hours.

Examples 2 to 12

Preparation of Zirconium Alloy Compositions

Zirconium alloy compositions having a low hydrogen pick-up rate and high hydrogen embrittlement resistance were prepared in the same method as in example 1, except for the chemical composition of each of the zirconium alloys. The chemical compositions of each of the zirconium alloy were given in Table 1 below.

TABLE 1

| Class. | Niobium (wt %) | Scandium (wt %) | Tin (wt %) | Iron (wt %) | Chromium (wt %) | Copper (wt %) | Aluminum (wt %) | Zirconium (wt %) |
|---|---|---|---|---|---|---|---|---|
| Ex. 1 | 1.0 | 0.1 | 0.2 | 0.05 | — | — | 0.05 | residue |
| Ex. 2 | 1.2 | 0.2 | 0.2 | 0.05 | — | — | 0.05 | residue |
| Ex. 3 | 1.4 | 0.3 | 0.2 | 0.05 | — | — | 0.05 | residue |
| Ex. 4 | 1.0 | 0.1 | — | — | — | 0.06 | 0.05 | residue |
| Ex. 5 | 1.2 | 0.2 | — | — | — | 0.06 | 0.05 | residue |
| Ex. 6 | 1.4 | 0.3 | — | — | — | 0.06 | 0.05 | residue |
| Ex. 7 | 1.2 | 0.1 | — | — | 0.15 | — | 0.05 | residue |
| Ex. 8 | 1.3 | 0.2 | — | — | 0.15 | — | 0.05 | residue |
| Ex. 9 | 1.4 | 0.3 | — | — | 0.15 | — | 0.05 | residue |
| Ex. 10 | 1.2 | 0.1 | — | — | 0.20 | — | — | residue |
| Ex. 11 | 1.3 | 0.2 | — | — | 0.20 | — | — | residue |
| Ex. 12 | 1.4 | 0.3 | — | — | 0.20 | — | — | residue |

Comparative Example 1

Preparation of Zirconium Alloy Composition

A zircaloy-4, which is a commercially available zirconium alloy used for nuclear fuel cladding tubes and structural materials in a nuclear power plant, was used.

Test Example 1

Hydrogen Pick-Up Rate Test

In order to evaluate the hydrogen pick-up rate and hydrogen embrittlement resistance of the zirconium alloy compositions according to the present invention, a hydrogen pick-up rate test was conducted as follows.

The hydrogen-charging plate specimens for zirconium alloy compositions of examples 1 to 12 were produced by the above manufacture process with the size of 20 mm×20 mm×1.0 mm. And then these hydrogen-charging specimens were mechanically polished to a roughness of #400 to #1200 by SiC sandpaper to have uniform surface roughness. The surface-polished hydrogen-charging specimens were washed with an acid solution containing water, nitric acid and hydrofluoric acid at a volume ratio of 50:40:10 to remove impurities and oxide films from the surface thereof, ultrasonically washed with acetone, and then sufficiently dried.

The zircaloy-4 cladding tube of comparative example 1 was also surface-polished, acid-washed, ultrasonically washed and dried in the same method as in the pretreatment of the specimens.

The sufficiently dried hydrogen-charging specimens were respectively charged with hydrogen for 1 hour, 3 hours and 5 hours using a hydrogen-charging apparatus. At this time, the zircaloy-4 cladding tube of comparative example 1 was also charged with hydrogen.

The hydrogen-charging apparatus introduces a gas mixture of argon and hydrogen (volume ratio: 95:5) having high purity (99.999% or more) into a chamber at a temperature of 430° C. under a high vacuum of $10^{-5}$ torr or less. The hydrogen gas in the chamber permeates into the matrix of a zirconium alloy to form hydrides at the solid solubility of the zirconium alloy.

After the completion of hydrogen charging, the hydrogen pick-up rate of each of the specimens was measured to quantitatively evaluate the degree of hydrogen embrittlement thereof. The hydrogen analysis of the hydrogen-charged specimens was conducted using a hydrogen analyzer (RH-400, manufactured by RECO Corporation). Further, the hydrogen analysis thereof was conducted using by the inert gas fusion-thermal conductivity detection (IGF-TCD) method. The results of hydrogen analysis thereof are given in Table 2 below.

TABLE 2

| | Amount of hydrogen absorbed after hydrogen charging at 430° C. using hydrogen-charging apparatus (ppm) | | |
|---|---|---|---|
| Class. | 1 hour | 3 hours | 5 hours |
| Example 1 | 98 | 223 | 321 |
| Example 2 | 64 | 195 | 188 |
| Example 3 | 77 | 209 | 272 |
| Example 4 | 189 | 297 | 409 |
| Example 5 | 136 | 303 | 375 |
| Example 6 | 143 | 362 | 422 |
| Example 7 | 121 | 242 | 361 |
| Example 8 | 81 | 170 | 207 |
| Example 9 | 89 | 198 | 323 |
| Example 10 | 71 | 242 | 202 |
| Example 11 | 76 | 212 | 129 |
| Example 12 | 62 | 209 | 198 |
| Zircaloy-4 | 216 | 699 | 1245 |

As given in Table 2 above, it can be ascertained that the hydrogen pick-up rates of the zirconium alloy compositions of examples 1 to 12 are 3~7 times lower than that of zircaloy-4 of comparative example 1. Particularly, it can be ascertained that the zirconium alloy compositions of examples 10 to 12, each of which does not contain aluminum, exhibit lower hydrogen pick-up rate and higher hydrogen embrittlement resistance than those of other zirconium alloy compositions.

As described above, the zirconium alloy composition of the present invention has a low hydrogen pick-up rate and high hydrogen embrittlement resistance compared to other conventional zirconium alloy composition. The zirconium alloy composition of the present invention can be usefully used as nuclear fuel components such as cladding etc. in a nuclear power plant because it has a very low hydrogen pick-up rate and high hydrogen embrittlement resistance under operation environments of nuclear power plant.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A zirconium alloy composition having a hydrogen pick-up rate and a hydrogen embrittlement resistance, comprising: niobium 1.0~1.4 wt %; scandium 0.1~0.3 wt %; aluminum 0.04~0.06 wt %; tin 0.1~0.3 wt %; iron 0.04~0.06 wt %; and a residue of zirconium.

2. A zirconium alloy composition having a hydrogen pick-up rate and a hydrogen embrittlement resistance, comprising: niobium 1.0~1.4 wt %; scandium 0.1~0.3 wt %; aluminum 0.04~0.06 wt %; copper 0.04~0.08 wt %; and a residue of zirconium.

3. A zirconium alloy composition having a hydrogen pick-up rate and a hydrogen embrittlement resistance, comprising: niobium 1.2~1.4 wt %; scandium 0.1~0.3 wt %; aluminum 0.04~0.06 wt %; chromium 0.1~0.2 wt %; and a residue of zirconium.

4. A zirconium alloy composition having a hydrogen pick-up rate and a hydrogen embrittlement resistance, comprising: niobium 1.2~1.4 wt %; scandium 0.1~0.3 wt %; chromium 0.1~0.3 wt %; and a residue of zirconium.

* * * * *